US005607073A

United States Patent [19]

Forrer

[11] Patent Number: 5,607,073

[45] Date of Patent: Mar. 4, 1997

[54] VALVE

[76] Inventor: Scott M. Forrer, 1238 Lizbeth La., Cedarburg, Wis. 53012

[21] Appl. No.: 603,157

[22] Filed: Feb. 20, 1996

[51] Int. Cl.[6] ..... A61J 9/00

[52] U.S. Cl. ..... 215/11.4; 220/714; 220/717

[58] Field of Search ..... 215/11.4, 11.5; 220/714, 717

[56] References Cited

U.S. PATENT DOCUMENTS

| | | | |
|---|---|---|---|
| 2,623,524 | 12/1952 | Clemens | 215/11.4 |
| 2,803,251 | 8/1957 | White | 215/11.4 |
| 2,876,772 | 3/1959 | Witz | 215/11.4 |
| 2,979,078 | 4/1961 | Witz | 215/11.4 X |
| 4,135,513 | 1/1979 | Arisland . | |
| 4,946,062 | 8/1990 | Coy . | |
| 5,072,842 | 12/1991 | White | 215/11.4 |
| 5,079,013 | 1/1992 | Belanger . | |

FOREIGN PATENT DOCUMENTS

| | | | |
|---|---|---|---|
| 2169210 | 7/1986 | United Kingdom | 215/11.4 |

*Primary Examiner*—Stephen K. Cronin
*Attorney, Agent, or Firm*—Joseph S. Heino

[57] ABSTRACT

A valve is provided which includes a dispensing spout and a spout insert. The spout insert includes a pair of upwardly extending posts which project up and into the spout. The spout urges the posts towards each other and a valve bridge extends between the posts and overlays a hole defined in the spout insert through which liquid flows when a suction force is applied to the spout. When no suction force is applied to the spout, the valve bridge closes the hole.

2 Claims, 1 Drawing Sheet

FIG. 1
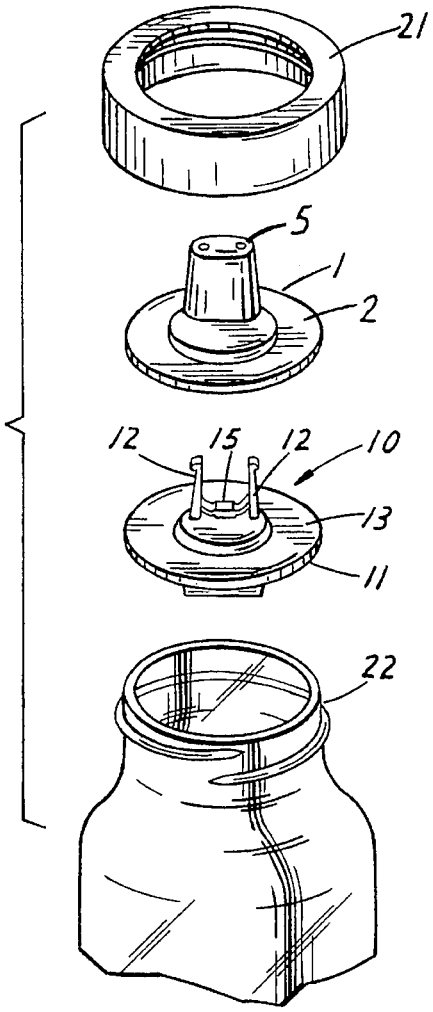
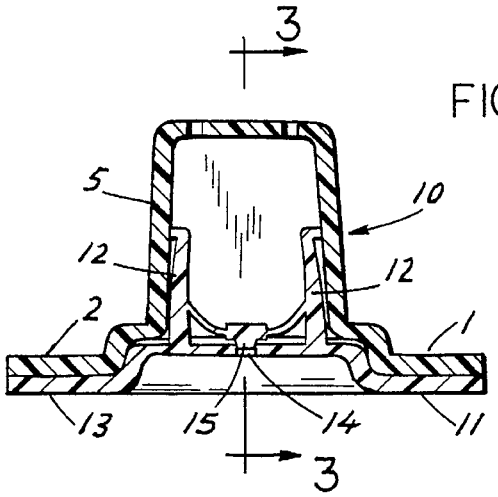
FIG. 2
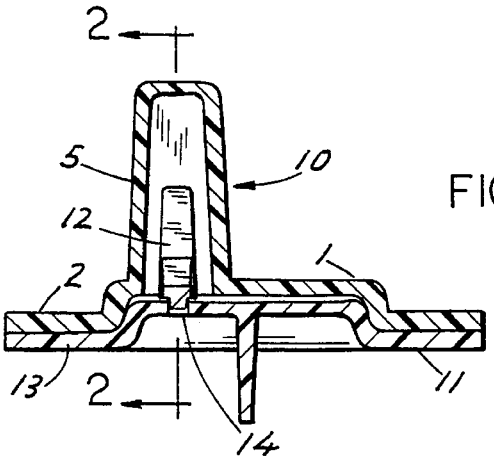
FIG. 3
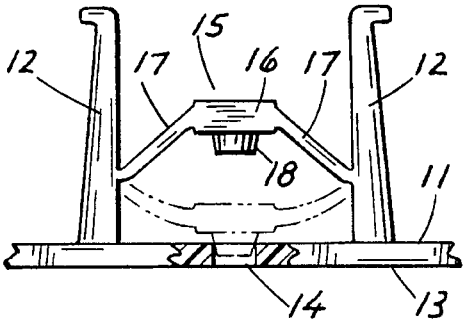
FIG. 4
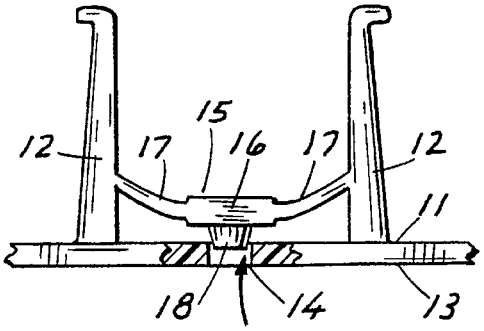
FIG. 5

VALVE

This application claims the benefit of U.S. Provisional Application No. 60/008,135, filed Oct. 31, 1995.

FIELD OF THE INVENTION

This invention relates generally to infant feeding and training containers, including toddler sipping cups and baby feeding bottles. More particularly, it relates to a valve to be used with the spouts of such liquid dispensing containers for controlling the flow of liquid from the container.

BACKGROUND OF THE INVENTION

It has long been recognized that babies and toddlers require some sort of controlled drinking mechanism when they start the self-feeding process and for some time thereafter. Such devices have included and ranged from the most elemental type of baby bottle nipple to more complex spring-loaded valve mechanisms. A problem common to each is that the valve mechanisms tend to be unreliable. Reliability has, on occasion, been enhanced. And it has been enhanced often, in this inventor's experience, at a significant sacrifice in simplicity, ease of construction and cleanability.

SUMMARY OF THE INVENTION

It is, therefore, a principal object of this invention to provide a new, useful and uncomplicated apparatus for actuating and controlling the liquid flow from a baby bottle and/or from a toddler's drinking cup. It is a further object of this invention to provide such an apparatus which requires only a minimal number of elements and which requires only a minimal number of steps to utilize. It is yet another object of this invention to provide such an apparatus which can be reliably used by infants and toddlers and which can be easily cleaned after use.

The present invention has obtained these objects. It provides for a valve which includes a spout insert to be used with a dispensing spout from which the liquid flows. The spout insert includes a pair of upwardly extending posts which project up and into the spout. Between the posts is a valve bridge. The valve bridge overlays a hole defined in the spout insert through which liquid flows when a suction force is applied to the spout. When no suction force is applied to the spout, the bridge effectively closes the hole. The foregoing and other features of the device of the present invention will be further apparent from the description which follows.

BRIEF DESCRIPTION OF THE DRAWINGS

FIG. 1 is an exploded front perspective view of the valve of the present invention as it is used with a conventional baby bottle.

FIG. 2 is an enlarged cross-sectional and front elevational view of the valve shown in FIG. 1 and taken along line 2—2.

FIG. 3 is another enlarged cross-sectional view of the valve shown in FIG. 2 but taken along line 3—3.

FIG. 4 is a further enlarged front elevational view of a portion of the valve shown in FIG. 1 and showing the details of the valve seat in its upward manufactured position and downward normally closed position.

FIG. 5 is another further enlarged front elevational view of that portion of the valve shown in FIG. 4 and showing the valve seat in the working open position.

DETAILED DESCRIPTION

Referring now to the drawings in detail, FIG. 1 shows a valve assembly, generally identified 10, constructed in accordance with the present invention. In the preferred embodiment, the valve assembly 10 is interposed between a baby bottle 22 which is filled with a consumable liquid and a bottle twist cap 21. The valve assembly 10 includes a spout member 1 and a valve member 11. The spout member 1 is so constructed and configured that it overlays the valve member 11 of the valve assembly 10. The spout member 1 includes a flange portion 2 and a spout 5. The valve member 11 includes a valve flange 13 and a pair of upwardly extending posts 12 between which extends a valve bridge 15. The valve member 11 is made of a somewhat resilient material, unlike the spout member 1 which is made of a generally rigid material and is not collapsible by a user's mouth, the significance of which will become more apparent further into this detailed description.

In the preferred embodiment, the valve bridge 15 which extends between the posts 12 includes a central seat member 16 each side of which is connected to one end of a supporting member 17. The opposite end of each supporting member 17 is attached to one of the upwardly extending posts 12. The underside of the central seat member 16 includes an integral valve seat 18. See FIG. 4. The valve seat 18 is functionally adapted to engage a whole 14 defined within the center of the valve flange 13. See FIG. 5.

In application, the central seat member 16 and the integral valve seat 18 are intended to be pulled up and away from the flange hole 14 when a suction force is applied to the spout 5. This action is due in large part to the resiliency of the valve bridge 15 and the upwardly extending posts 12. The posts 12 and the seat supporting members 17 have enough memory in them to allow the central seat member 16 and the integral valve seat 18 to return to normal position and thereby close off the flow of liquid through the flange hole 14 when the suction force is removed. It is also readily apparent that the spout member 1 and the valve member 11 can be easily separated and cleaned when such is required or desired.

From the foregoing detailed description of the illustrative embodiment of the invention set forth herein, it will be apparent that there has been provided a new, useful and uncomplicated apparatus for actuating and controlling the liquid flow from a baby bottle and/or from a toddler's drinking cup which requires only a minimal number of elements, which requires only a minimal number of steps to utilize and which can be reliably used by infants and toddlers and which can be easily cleaned after use.

The principles of this invention having been fully explained in connection with the foregoing, I hereby claim as my invention:

1. A closure lid assembly for bottles or other containers which comprises a first lid member, said first lid member being functionally adapted to be introduced in a tightenable manner within a bottle or container opening, said first lid member comprising a generally planar disk having a top surface and a bottom surface, said bottom surface facing inwardly of the container and said top surface having a pair of flexible posts extending upwardly therefrom, said first lid member further having an aperture defined in it, a second lid member, said second lid member being generally rigid and functionally adapted to overlay said first lid member, said second lid member having an apertured spout defined in it and including a spout cavity into which the flexible posts of the first lid member extend, and a valve means defined between the aperture of said first lid member and the apertured spout of said second lid member, said valve means including a flexible bridge extending between the flexible posts of the first lid member and including means for bringing said flexible bridge into sealingly engagement with said first lid member aperture and for closing the aperture defined within said first lid member when the posts of the first lid member are received within the spout cavity of the second lid member and flexed toward each other.

2. A drinking nozzle apparatus for bottles or other similar containers which comprises a base member, said base member being adapted to be introduced in a tightenable manner within a bottle or container opening and having an aperture defined in it, said base member comprising a generally planar disk having an upper surface and a bottom surface, said bottom surface facing inwardly of the container, and said base member further having a pair of flexible posts extending upwardly from the upper surface of said base member, a cover member, said cover member being generally rigid and adapted to overlay said first lid member and having an apertured spout member defined in it and further having a spout cavity which is adapted to receive the flexible posts of the base member within the cavity, and a valve means defined between said base member and said cover member, said valve means including a flexible bridge extending between the base member posts for sealing the aperture defined within said base member and further including means for bringing said flexible bridge into sealingly engagement with said base member aperture when said posts are received within said cover member spout cavity and flexed toward each other.

* * * * *